US005172527A

United States Patent [19]

Ault

[11] Patent Number: 5,172,527

[45] Date of Patent: Dec. 22, 1992

[54] ACOUSTICAL DECK PANEL ASSEMBLY

[75] Inventor: Robert L. Ault, Saltzburg, Pa.

[73] Assignee: Epic Metals Corporation, Rankin, Pa.

[21] Appl. No.: 707,874

[22] Filed: May 31, 1991

[51] Int. Cl.[5] ..... E04B 1/82

[52] U.S. Cl. ..... 52/145; 52/451; 52/674

[58] Field of Search ..... 52/144, 145, 334, 450–454, 52/674, 795

[56] References Cited

U.S. PATENT DOCUMENTS

| | | | |
|---|---|---|---|
| 840,016 | 1/1907 | Schafly | 52/450 |
| 1,317,519 | 9/1919 | Madison | 52/454 |
| 2,001,733 | 5/1935 | Kellogg | 52/144 |
| 2,007,374 | 7/1935 | Kuehne | 52/795 |
| 2,219,806 | 10/1940 | Buttress | 52/451 |

*Primary Examiner*—James L. Ridgill, Jr.

*Attorney, Agent, or Firm*—Webb, Burden, Ziesenheim & Webb

[57] ABSTRACT

An acoustical ceiling roof panel assembly including a plurality of roof deck panels assembled in side-by-side relationship and secured to roof supports with each panel including a plurality of parallel and spaced apart perforated flat sections. Each flat section is separated from its adjacent flat section by a rib section, and has a width at least three times and preferably five times greater than the width of the rib section as measured in the plane of the flat section. Lengths of insulation are positioned between adjacent ribs so as to substantially fill the space formed by the adjacent ribs and the flat section. A wire mesh spacer is positioned within the space between each perforated flat section and the insulation to maintain the insulation in spaced relationship to the flat section.

14 Claims, 2 Drawing Sheets

ACOUSTICAL DECK PANEL ASSEMBLY

BACKGROUND OF THE INVENTION

1. Field of the Invention

This invention relates to metal roof deck assemblies and more particularly to acoustical roof panel assemblies having structural integrity, efficient sound absorbing properties and superior thermal insulation values.

2. Description of the Prior Art

Convention centers, arenas, office buildings and other major structures normally must provide for the economical handling of noise control. One way to accomplish this is to form metal roof panels into acoustical ceiling roof panel assemblies to meet the necessary noise reduction coefficients.

Conventional acoustical roof decking consists of a metal panel which forms a balanced section over the ceiling supports. By balanced section, it is meant that the panels include alternating flats and ribs of approximately the sam width. In order not to materially reduce the load bearing capacity of the panel, perforations ar placed in the sidewalls of the ribs and not on the flat surfaces which form the ceiling and which extend between ribs. Fiberglass units are then laid in the ribs to complete the acoustical ceiling.

At one time, Fenestra Incorporated produced an acoustical roof in which the width of the flats substantially exceeded the width of the ribs and perforations occurred along the flats. This product included a sound absorbing element formed of a formed arched pad, one inch thick, molded from a one-pound density, extra fine glass fiber. The sound absorbing element was placed between the ribs and a ply of roofing felt was laid dry over the tops of the exposed ribs and sound absorbing element to form a vapor seal and asphalt stop. However, because the insulation element had an arched configuration, special equipment had to be designed and the insulation custom made. This substantially increased the cost of the product so as to be noncompetitive with the conventional prior art acoustical deck. In general, it is also known to use spacers to separate a sound absorbing pad from the face of the ceiling, see U.S. Pat. Nos. 2,293,351; 2,271,929; 2,148,496; 2,112,631 and 1,899,403.

A need remains for an acoustical metal roof deck panel assembly providing adequate structural support and efficient sound absorbing properties which can be manufactured with existing conventional techniques. The need also exists for an acoustical panel which can be finally painted after installation without getting substantial amounts of paint on the insulation member itself.

SUMMARY OF THE INVENTION

My acoustical roof panel assembly accomplishes all of the above-stated objectives and consists of a plurality of roof deck panels assembled in side-by-side and/or end-to-end relationship and secured to roof supports such as purlins with each panel including a plurality of parallel and spaced apart perforated flat sections, with each flat section being separated from its adjacent flat section by a frusto-pyramidal rib section. The flat sections have a width at least three times greater than the width of the rib as measured in the plane of the flat section and preferably a width five times greater than the width of the rib. Lengths of insulation are positioned within the ribs and atop a spacer means which spaces the insulation from the inner surface of the flats. The preferred spacer is a reticulated wire mesh positioned in contact with and between each of the perforated flat sections and the length of insulation positioned between adjacent ribs. The insulation is preferably fiberglass and the assembly has a noise reduction coefficient on the order of0.95 to 1. There preferably are no perforations in the area of the ribs.

BRIEF DESCRIPTIONS OF THE DRAWINGS

DESCRIPTIONS OF THE PREFERRED EMBODIMENT

Figure 1:
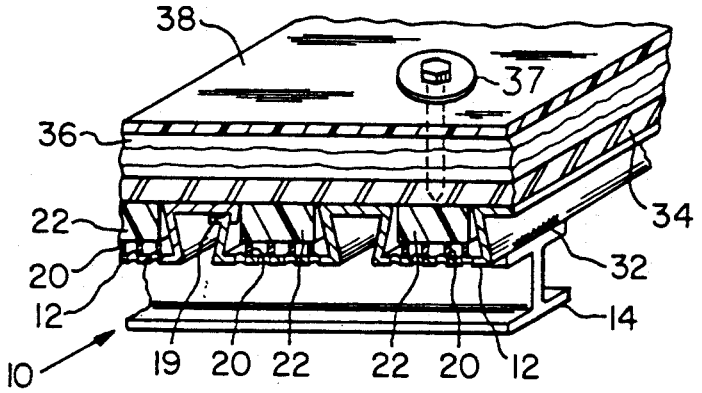
FIG. 1 is a perspective view partly in section of a portion of an entire roof assembly including a pair of acoustical ceiling roof panel units.

A portion of an entire roof system, including the acoustical ceiling roof panel assembly, generally designated 10 is illustrated in FIG. 1. The roof panel assembly 10, which includes a metal roof deck panel 12, is positioned on transversely extending purlins 14 which are generally spaced on 6 foot to 12 foot centers and are connected to the building superstructure by conventional means recognized in the art.

The acoustical ceiling roof panel assembly 10 is connected to the purlins 14 by welds 32 with the size and location of the welds being in compliance with conventional or specified erection instructions. The assembly 10 is then covered with a thin gypsum board 34, which in turn is covered with conventional therma insulation 36. The thermal insulation 36 is secured in place by means of threaded fasteners and fastener plates 37 which connect to the gypsum board 34 or metal roof deck panels 12. The thermal insulation 36 is normally covered with a single ply plastic material (not shown), although it will be recognized that other forms of conventional roof construction can be used in conjunction with the acoustical ceiling roof panel assembly 10 of m invention.

Figure 2:
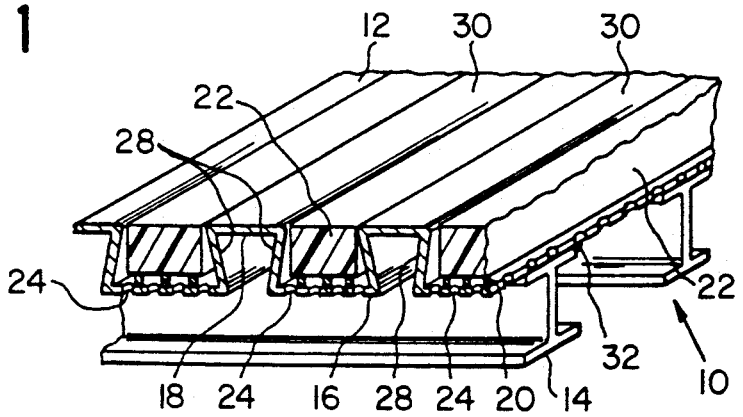
FIG. 2 is a perspective view partly in section showing a portion of the acoustical ceiling roof panel unit.
Figure 3:
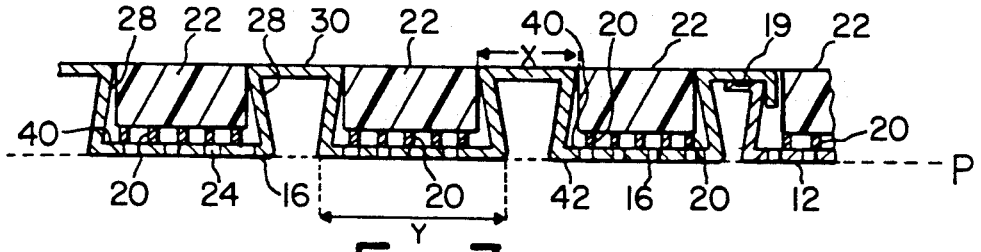
FIG. 3 is a section of a portion of the acoustical ceiling roof panel unit.

The entire assembly 10 is best seen in FIGS. 2 and 3. The individual components of the assembly 10 are metal panel 12, wire mesh 20 and acoustic insulation 22.

Figure 4:
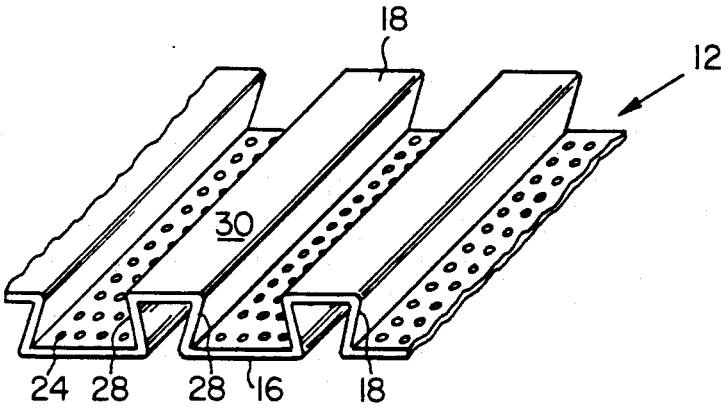
FIG. 4 is a perspective view of a portion of a metal panel.
Figure 5:
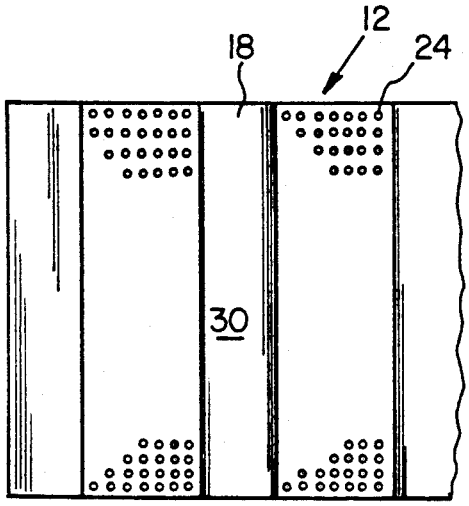
FIG. 5 is a top view of the metal panel.

The structural component of the assembly 10 is the metal roof deck panel 12 shown in FIGS. 4 and 5. This panel 12 is roll-formed from coils of the appropriate gauge coated steel or uncoated steel (example: 16 to 22 gauge), which are then cut into specified sheet lengths. Each panel 12 consists of parallel extending alternately positioned flats 16 and ribs 18. The panels 12 terminate along their longitudinal edges in side laps 19 normally of the interlocking type so that panels can be joined in side-by-side relationship, see FIG. 3. The panels may also terminate in end laps so that panels may likewise be positioned in end-to-end relationships. The side laps and end laps (where required) are conventional and do not form a part of this invention.

The flats 16 contain a substantial plurality of perforations 24. The number of perforations will vary depending upon the acoustical requirements. A typical requirement would be ⅛ inch round holes of approximately 1100 per square foot. The ribs 18 are formed by two diverging side walls 28 each of which connects to an adjacent flat 16. A top wall 30 connects the diverging end walls 28 to each other. The top wall 30 extends in a plane parallel to the plane, of the flats 16. The ribs 18 are frusto-pyramidal in cross-section. The flats 16 have a width dimension.generally at least three times and preferably five times greater than the width dimension of ribs 18 as measured in the plane of the flats. The typical width for a flat 16 would be 5½ inches with the width of the rib 18. as measured in the plane of the flat being ⅝ of an inch. The depth of the rib 18 would typically be 2 inches. A typical panel is 2 feet wide and consists of four flats and three ribs.

Figure 6:
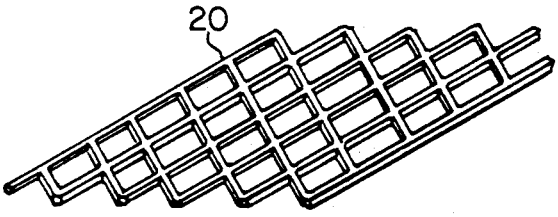
FIG. 6 is a perspective view of the reticulated metal mesh spacer.

The reticulated expanded metal mesh 20 is positioned within the rib 18 adjacent to a top surface 40 of flat 16, see FIGS. 3 and 6. The metal mesh acts as a spacer between the panel and the fiberglass insulation 22. The metal mesh 20 which is a conventional expanded metal wire permits painting of the exposed bottom surface of the flats 16 without getting a lot of paint on the insulation 22. Paint detrimentally effects the acoustical properties of the insulation 22. In addition, by positioning the insulation 22 on the wire mesh 20, some advantage is achieved in the sound deadening capacity of the assembly 10. Preferably, the bottom surface 42 of the panel 12 is painted with a finish coat after it is attached to the purlins 14, and the mesh 20 and insulation 22 are set in place.

Figure 7:
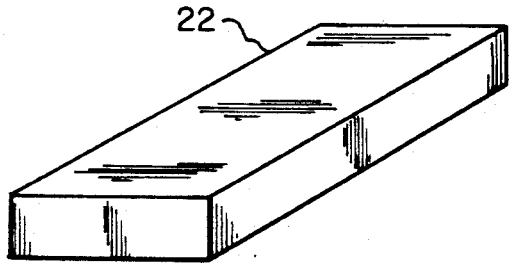
FIG. 7 is a perspective view of the fiberglass insulation.

The insulation 22, best seen in FIG. 7, is preferably a fiberglass type of insulation having a density on the order of 3 pounds per cubic foot and a thickness of 2 inches.

The panel assembly 10 of the type described hereinabove will have a noise reduction coefficient on the order of 0.95 to 1. Further, it is easily assembled and does not require any custom fabricated components. Finally, the structural integrity of the metal panel is maintained even though the flats of the metal panel are substantially perforated.

Generally, panel 12, which does not have a painted finish coat, is first attached to the purlin 14. Then the mesh 20 is set in place and the insulation 22 is then placed on top of the mesh 20 so that the mesh 20 is positioned between the flat 16 and the insulation 22. The panel 12 and purlin 14 are then painted with the finish coat.

While the preferred embodiment of the invention has been described herein, it is to be understood that the invention may be otherwise embodied within the scope of the appended claims.

I claim:

1. In an acoustical ceiling roof panel assembly, the improvement comprising:

a plurality of roof deck panels assembled in side-by-side relationship and secured to roof supports, each panel including a plurality of parallel and spaced apart, substantially perforated flat sections with each flat section being separated from its adjacent flat section by a rib section, and having a width within the range of three to five times greater than the width of the rib section as measured in the plane of the flat section, lengths of insulation positioned between adjacent ribs so as to substantially fill a space formed by said adjacent ribs and a flat section; and spacer means positioned within said space between each perforated flat section and said insulation to maintain said insulation in spaced relationship to said flat section, whereby said system has a noise reduction coefficient on the order of 0.95 to 1.

2. The improvement of claim 1 wherein each flat section has a width 5 times greater than the width of the rib section as measured in the plane of the flat section.

3. The improvement of claim 1 wherein each rib section is defined by a pair of diverging end walls with each end wall diverging from a flat section and a top wall connecting said end walls to form a frusto-pyramidal cross-section, said end walls and top wall being imperforate.

4. The improvement of claim wherein the insulation is substantially rectangular in cross-section.

5. The improvement of claim 1 wherein said deck panels do not have a finish coat of paint when attached to said roof supports.

6. The improvement of claim 1 wherein the roof supports comprise spaced purlins running transverse of a panel longitudinal axis.

7. The improvement of claim 6 wherein the panels are spot welded to the purlins.

8. The improvement of claim 1 wherein said spacer means is a reticulated wire mesh.

9. The improvement of claim 8 wherein said insulation is fiberglass.

10. The improvement of claim 9 wherein said fiberglass has a density of at least 3 pounds per cubic foot and is at least 2 inches thick.

11. A method for making an acoustical ceiling comprising:

(a) forming a deck panel having a plurality of parallel and spaced apart, substantially perforated flat sections with each flat section being separated from its adjacent flat section by a rib section, and having a width within the range of three to five times greater than the width of the rib section as measured in the plane of the flat section;

(b) placing spacers within spaces formed by adjacent ribs of the deck panel;

(c) placing lengths of insulation between said adjacent ribs and on said spacers so that said spacer is positioned between said insulation and said flat section;

(d) attaching said panel to a roof support; and (e) painting an underside of said panel

12. The method of claim 11 wherein each flat section has a width 5 times greater than the width of the rib section as measured in the plane of the flat section.

13. The method of claim 11 wherein said spacers are formed of reticulated wire mesh.

14. The method of claim 11 wherein each rib section is defined by a pair of diverging end walls with each end wall diverging from a flat section and a top wall connecting said end walls to form af rusto-pyramidal cross-section, said end walls and top wall being imperforate.

* * * * *